US007998378B2

(12) United States Patent
Ali et al.

(10) Patent No.: US 7,998,378 B2
(45) Date of Patent: Aug. 16, 2011

(54) METHOD OF MAKING COMPOSITE SUPPORT STRUCTURE FOR USE IN SANDING AND SANDERS FORMED THEREFROM

(75) Inventors: Terry Ali, Fairborn, OH (US); Christopher Ali, Beavercreek, OH (US)

(73) Assignee: Ali Industries, Inc., Fairborn, OH (US)

( * ) Notice: Subject to any disclaimer, the term of this patent is extended or adjusted under 35 U.S.C. 154(b) by 209 days.

(21) Appl. No.: 12/132,671

(22) Filed: Jun. 4, 2008

(65) Prior Publication Data

US 2008/0230939 A1 Sep. 25, 2008

Related U.S. Application Data

(63) Continuation-in-part of application No. 11/419,225, filed on May 19, 2006, now Pat. No. 7,396,276.

(51) Int. Cl.
*B29C 67/00* (2006.01)

(52) U.S. Cl. ..... 264/46.4; 264/46.5; 24/306; 24/444

(58) Field of Classification Search ..... 264/46.5, 264/46.4; 451/490, 538; 24/306, 444
See application file for complete search history.

(56) References Cited

U.S. PATENT DOCUMENTS

| | | | | |
|---|---|---|---|---|
| 2,711,059 | A | 6/1955 | Ames | |
| 4,115,170 | A * | 9/1978 | Sanson | 156/79 |
| 4,397,625 | A * | 8/1983 | Hellmer et al. | 425/135 |
| 4,663,796 | A | 5/1987 | Heiling | |
| 4,667,447 | A | 5/1987 | Barton | |
| 4,802,939 | A * | 2/1989 | Billarant et al. | 156/155 |
| 4,885,876 | A | 12/1989 | Henke | |
| 5,054,248 | A | 10/1991 | Thayer | |
| 5,230,844 | A * | 7/1993 | Macaire et al. | 264/46.7 |
| 5,245,797 | A | 9/1993 | Milkie | |
| 5,975,999 | A | 11/1999 | Nitta | |
| 6,059,644 | A * | 5/2000 | Manor et al. | 451/490 |
| 6,129,970 | A * | 10/2000 | Kenney et al. | 428/100 |
| 6,197,403 | B1 | 3/2001 | Brown et al. | |
| 6,325,708 | B1 | 12/2001 | Miles | |
| 6,524,175 | B2 | 2/2003 | Beaudry et al. | |
| 6,988,941 | B2 * | 1/2006 | Saunier et al. | 451/490 |
| 7,014,550 | B2 | 3/2006 | Mansfield et al. | |
| 2005/0059328 | A1 | 3/2005 | Madsen et al. | |

* cited by examiner

*Primary Examiner* — Richard Crispino
*Assistant Examiner* — Elizabeth Royston
(74) *Attorney, Agent, or Firm* — R. William Graham

(57) ABSTRACT

A method of making a composite support structure and sander includes the steps of providing a rigid plate adjacent a mold such that a polyfoam layer can be formed to a front surface thereof which includes a wall defining a contained surface, the plate having a back surface for connection to a handle and introducing into the mold fluid components which react to form a polyfoam which is reaction bonded to the front surface of the rigid plate such that a back surface of the polyfoam layer forms within the contained surface and about the wall in a complementary manner thereto and a front surface of the polyfoam layer extends outward from the front surface of the rigid plate and is formed to have a relatively planar surface thereby rendering the composite support structure for removably connecting sandpaper to the relatively planar surface of the polyfoam layer.

6 Claims, 8 Drawing Sheets

METHOD OF MAKING COMPOSITE SUPPORT STRUCTURE FOR USE IN SANDING AND SANDERS FORMED THEREFROM

This is a continuation-in-part of U.S. Ser. No. 11/419,225 filed May 19, 2006 now U.S. Pat. No. 7,396,276.

BACKGROUND OF THE INVENTION

1. Field of the Invention

The present invention relates to a novel composite support structure for use in sanding and sanders formed therefrom. More particularly, the invention relates to a method of making a composite support structure for use in sanding and method of a hand sander or pole sander.

2. Related Art

Various support structures for use in sanding have long existed. Pole sanders and hand sanders are well known in the art. Pole sanders apply pressure to the sandpaper surface through an elongated handle and usually employ some type of universal joint in order to permit the flat sandpaper surface, which is generally secured to a flat back surface of the sander, to parallel the wall or ceiling or floor surface against which the sandpaper is applied during the sanding operation. The support structure typically has sloped contoured guide ramps adjacent the universal joint and employ a positive friction engagement to aid the problems of controlling sander movement where the universal joint does not employ such a positive friction engagement. These sanders have employed many ways to hold the sandpaper on the sander. These sanders typically employ wire clips or other clamping mechanisms to retain the sandpaper. The prior art sanders have also attempted to used hook and loop technology between a support structure and sandpaper, but have yet to adequately provide a highly suitable solution. For example, the art has attempted to glue one hook/loop member to a rigid support structure and another hook/loop member to the sandpaper. These hook/loop members typically fail at the connection to the rigid support surface rendering the device useless. There is a continuous need to improve the sandpaper holding techniques on such sanders to ease the sanding process.

Other problems have centered on providing an adequate support structure for sanders which provides suitable durability and surface for easily attaching and removing sandpaper. There remains a need to improve composite support structure for use in sanding. The present invention solves many of the problems associated with such sanders and hand sanders currently existing in the marketplace. Accordingly, the present invention improves upon the art.

BRIEF SUMMARY OF THE INVENTION

It is an object of the invention to provide an improved composite support structure for use in sanding.

It is a further object of the invention to provide a durable composite support structure for use in sanding.

Still another object is to provide a composite support structure having a rigid component for use in sanding with improved sandpaper connecting means.

Yet another object is to provide a multifaceted composite support structure for use in sanding to enable hand and pole sanding.

It is another object to improve pole and hand sanders.

It is a further object to provide a sander having an improved composite support structure.

Accordingly, the present invention is directed to a composite support structure for use in sanding, which includes a rigid plate having a front surface which includes a wall defining a contained surface and a back surface for connection to a handle and a polyfoam layer having a front surface and a back surface, wherein the back surface of the polyfoam is reaction bonded to the front surface of the rigid plate such that the back surface of the polyfoam layer forms within the contained surface and about the wall in a complementary manner thereto and the front surface of the polyfoam layer extends outward from the front surface of the rigid plate and is formed to such that the front surface is relatively planar thereby rendering the composite support structure for removably connecting sandpaper to the back surface of the polyfoam layer. A hook and loop portion can be integrally formed into the front surface of the polyfoam as part of the composite support structure thereby enabling a hook/loop sandpaper to be attached thereto.

The rigid plate can have a surface including means for connecting a handle. The connecting means includes opposing raised support surfaces for receiving the handle therebetween, wherein each raised support surface includes a coaxially aligned opening therethrough. The handle or a part connecting the handle includes an opening therethrough which can be co-aligned with the openings in the raised support surfaces to receive a retaining member therethrough to retain the handle to the rigid plate member. In a preferred embodiment of the present invention, the connecting means is configured to enable interchangeable handle configurations. For example, a hand held loop handle can include a first intermediate portion extending longitudinally along the back surface in a laterally displaced manner therefrom and interconnecting two downwardly extending ends which connect to a second intermediate portion extending longitudinally adjacent the back surface and which includes the opening to receive the retaining member. The intermediate portions are spaced apart from one another to allow for placement of a user's hand about the first intermediate portion. The first intermediate portion can include a hill and valley contour configured to provide for a comfortable grip. It will be appreciated that this embodiment will provide a hand sander tool apparatus.

In another embodiment, the handle can be in the form of an elongated pole or broom handle. An end of the pole can connect to the retaining member via a hinge mechanism, such as a universal joint, to permit the pivoting of the handle. The universal joint includes the opening to likewise receive the retaining member and allows the composite support structure to be disposed in a plurality of angular positions with respect to the handle. The present invention also relates to a kit assembly including a composite support structure for use in sanding and interchangeable hand sander handle and pole handle, whereby the sander tool can be readily converted from a hand sander to a pole sander.

A method of forming the composite support structure for use in sanding is provided. The method includes positionably disposing within an injection mold a rigid plate having a front surface which includes a wall defining a contained surface and a back surface for connection to a handle such that the second surface is disposed on a first surface of the injection mold and injecting a polyfoam material around the first surface of the rigid plate in a manner such that a substantially uniform layer of the polyfoam is integrally connected thereto. The method further includes disposing a hook and loop member adjacent a second surface of the injection mold in a manner to maintain a gap between the hook and loop member and the rigid plate member. The step of injecting is further characterized to include injecting between the hook and loop member and the rigid plate the polyfoam.

Other objects and advantages will be readily apparent to those skilled in the art upon viewing the drawings and reading the detailed description hereafter. These and various other advantages and features of novelty which characterize the invention are pointed out with particularity in the claims annexed hereto and forming a part hereof. A better understanding of the invention, its advantages, and objects obtained by its use, reference should be had to the drawings which form a further part hereof, and to the accompanying description, in which there is illustrated and described a preferred embodiment of the invention.

BRIEF DESCRIPTION OF THE DRAWINGS

In the drawings, in which like reference letters and numerals indicate corresponding parts throughout.

DETAILED DESCRIPTION OF A PREFERRED EMBODIMENT

Figure 1:
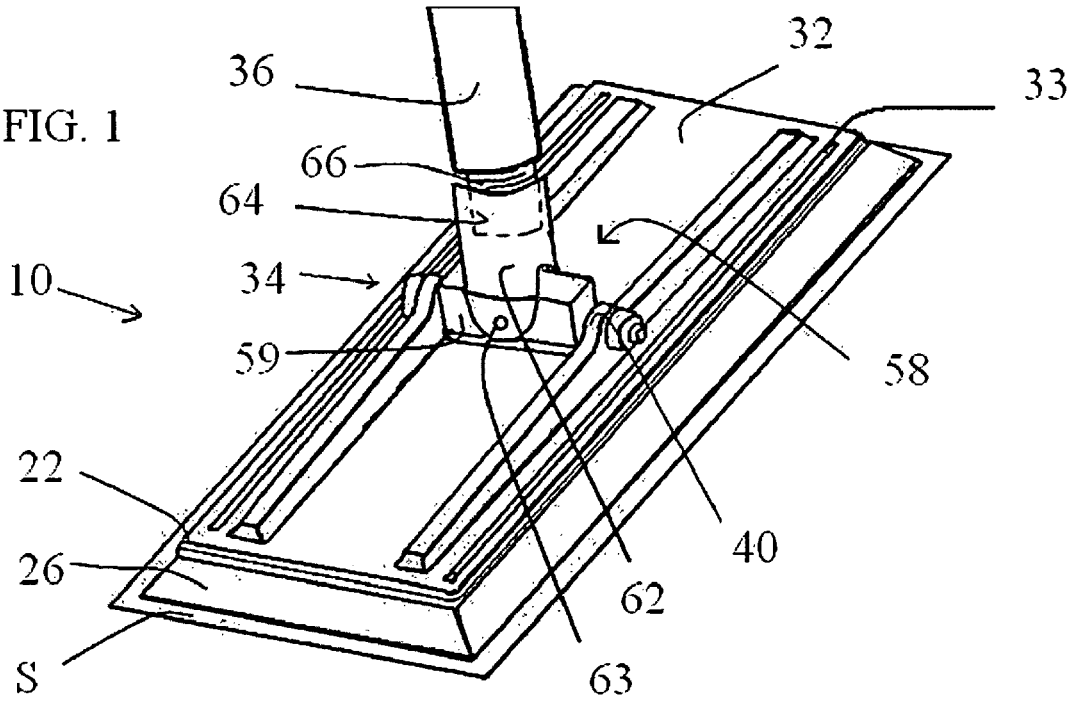
FIG. 1 is a view in perspective of an embodiment of a pole sander in accordance with the principles of the present invention.

Referring now to the figures, the embodiments depict a pole sander 10 and a hand sander 100 generally in accordance with the principles of the present invention. The pole sander 10 and the hand sander 100 include a composite support structure 20 for use in sanding which is identical for both.

The composite support structure 20 can generally be shown to include a rigid plate 22 and polyfoam layer 26. The rigid plate 22 preferably has a front surface 24 and a back surface 32. The polyfoam layer 26 has a front surface 28 and a back surface 30, wherein the back surface 30 is bonded to the front surface 24 of the rigid plate 22. When bonded, there is formed the suitable composite support structure 20 for removably connecting sandpaper S thereto. The composite support structure 20 for use in sanding can be of any suitable width and length so that a user can readily employ sheets of standard size sandpaper, e.g., cut sandpaper strips as well as full sandpaper sheets.

In one embodiment, the rigid plate 22 can be a metal (but could also be of a plastic material) wherein the front surface 24 can be generally planar and the polyfoam layer 26 is formed thereto in a generally uniform manner via the mold 112 to provide the front surface 28 with a generally planar shape. The back surface 32 can also include a plurality of ribs 33 extending thereacross to lend rigidity.

Figure 8:
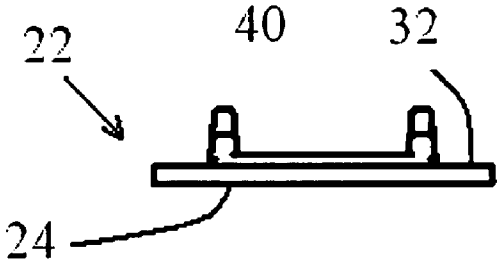
FIG. 8 shows an end view of the rigid plate in FIG. 7.
Figure 7:
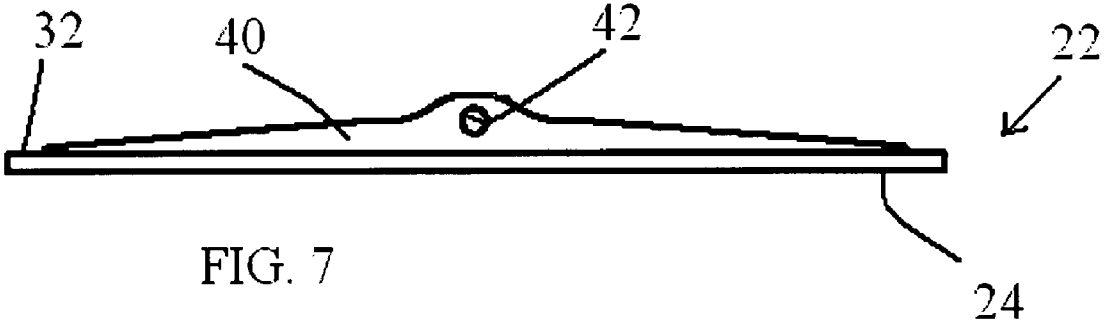
FIG. 7 shows a side view of a rigid plate used in the instant invention.
Figure 9:
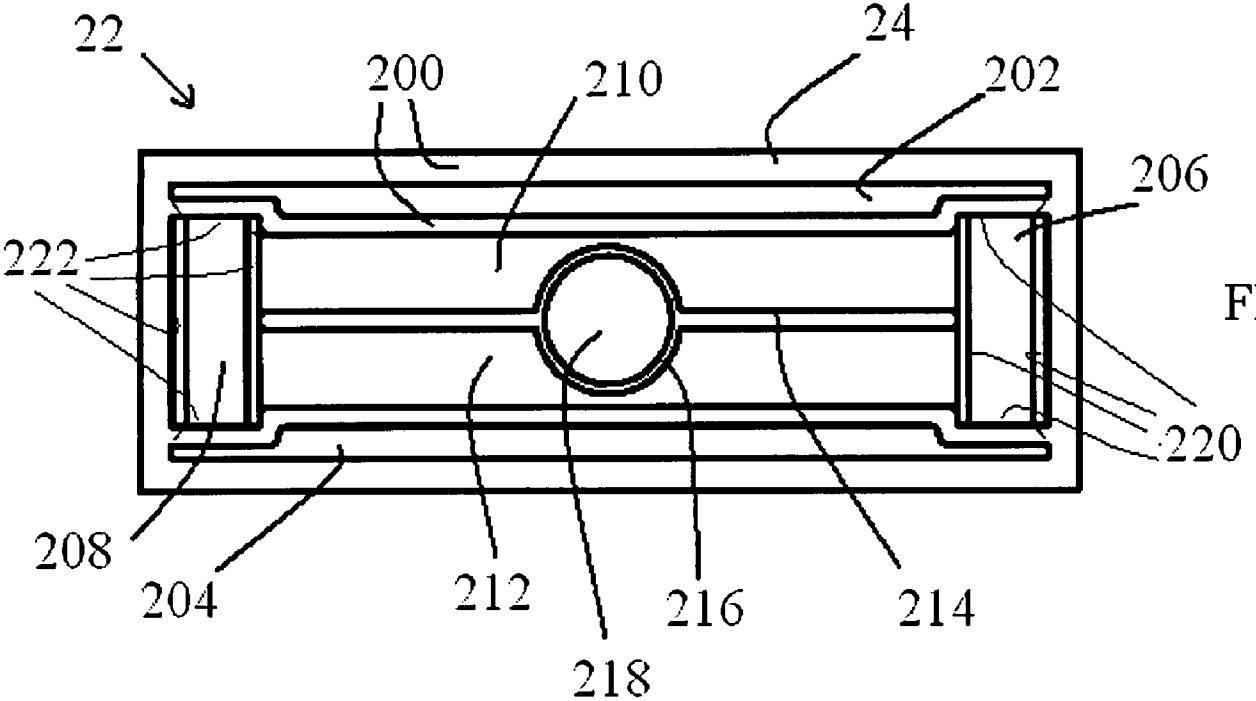
FIG. 9 shows a bottom view of a rigid plate in FIG. 7.
Figure 11:
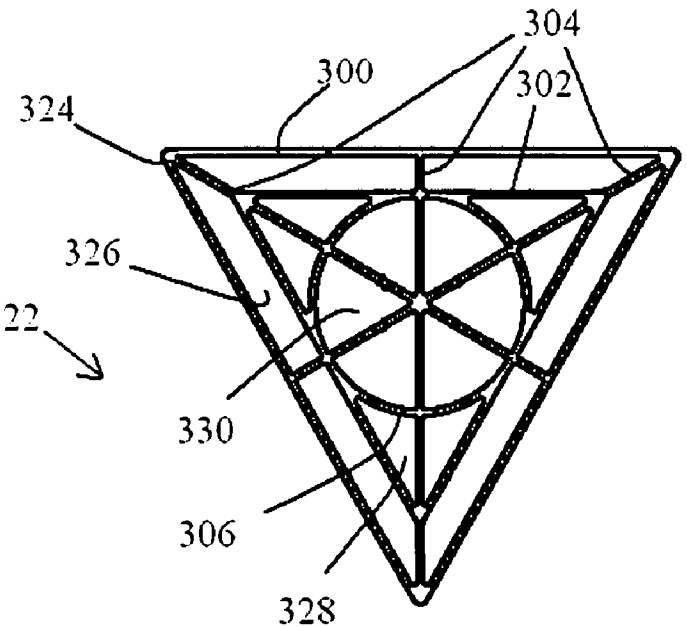
FIG. 11 is a bottom a bottom view of a rigid plate in FIG. 10.
Figure 10:
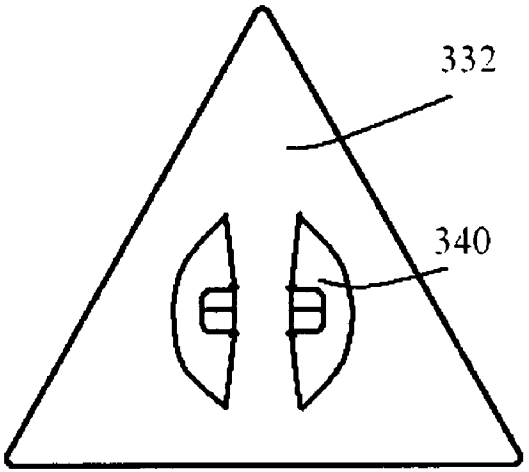
FIG. 10 shows a top view of another version of a rigid plate used in forming a composite structure of the instant invention.
Figure 13:
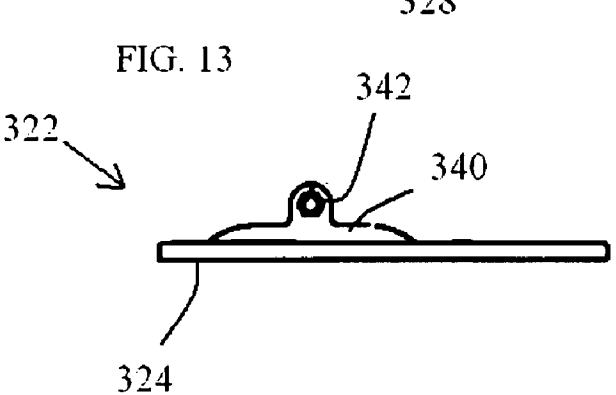
FIG. 13 is a side view of a rigid plate in FIG. 10.
Figure 12:
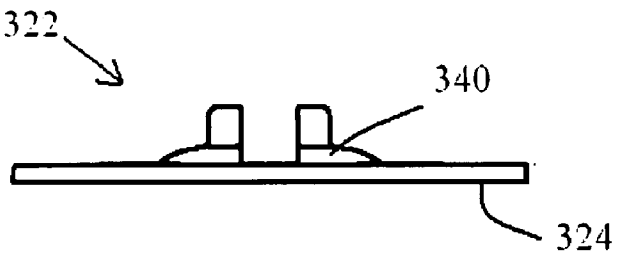
FIG. 12 is an end view of a rigid plate in FIG. 10.

In the embodiment as depicted in FIGS. 7-9, the rigid plate 22 is similarly formed with the exception of the front surface 24. Here, the front surface 24 includes a peripheral outer wall 200 which surrounds lengthwise contained surfaces 202 and 204 and partially surrounds transverse end contained surfaces 206 and 208 and lengthwise contained surfaces 210 and 212. The front surface 24 also includes an inner lengthwise wall 214 which generally divides contained surfaces 210 and 212 and further includes a generally circular wall portion 216 which surrounds contained surface 218. Transverse end contained surfaces 206 and 208 are bordered by wall portions 220 and 222, respectively which extend deeper inwardly into the rigid plate 22 than the contained surfaces 202, 204, 210, 212 and 218. The contained surfaces 202, 204, 206, 208, 210, 212 and 218 together with the walls 200, 214 and wall portions 216, 220 and 222 serve an important role in further aiding connection of the polyfoam layer 26 in addition to lending strength to the rigid plate 22. With the rigorous forces of sanding applied to the composite structure 20, this unique formed structure prevents undesirable separation of the polyfoam layer 26 from the rigid plate 22.

Another embodiment of the invention can employ an alternative configuration rigid plate 322. In this embodiment as depicted in FIGS. 10-13, the rigid plate 322 is formed with a triangular configuration. Here, the front surface 324 includes a triangular peripheral outer wall 300 and triangular inner wall 302, cross walls 304 and inner circular wall 306 surround contained surfaces 326. Triangular inner wall 302 and inner circular wall 306 surround contained surfaces 328 and cross walls 304 and inner circular wall 306 surround contained surfaces 330. Similarly, the contained surfaces 326, 328 and 330 together with the walls 300, 302, 304 and 306 serve an important role in further aiding connection of the polyfoam layer 26 in addition to lending strength to the rigid plate 322. It is understood here that although not shown, the polyfoam layer 26 will take on a triangular shape complementary to the rigid plate 322 in the forming process. Like the prior embodiment, this unique formed structure prevents undesirable separation of the polyfoam layer 26 from the rigid plate 22 during the sanding process.

The back surface 32 includes means 34 for connecting either a pole handle 36 or loop handle 38. The connecting means 34 includes opposing raised support surfaces 40 for receiving the pole handle 36 or the loop handle 38, for example, therebetween. Each raised support surface 40 includes a coaxially aligned opening 42 therethrough to receive a retaining member 44 which can be a locking pin or threaded bolt (with nut) therethrough.

The loop handle 38 includes an opening 46 therethrough which can be co-aligned with openings 42 of the raised support surfaces 40 and receive the retaining member 44 therethrough to retain the loop handle 38 to the rigid plate 22. The loop handle 38 can include a first intermediate portion 48 extending longitudinally along the back surface 32 in a laterally displaced manner therefrom and interconnects two downwardly extending ends 50 and 52 which connect to a second intermediate portion 54 which extends longitudinally adjacent the back surface 32 and includes the opening 46 to receive the retaining member 44. The intermediate portions 48 and 54 and ends 50 and 52 are spaced apart from one another to allow for placement of a user's hand about the first intermediate portion 48. The first intermediate portion 48 can include a hill and valley contour and is configured to provide for a comfortable grip. It will be appreciated that this embodiment will provide a suitable hand sander.

As stated, the connecting means 34 is configured to enable interchangeable handle configurations. Thus, an elongated pole or broom handle can be employed to form the pole handle 36. A pivot adapter 58 can be provided with a cross member 59 which includes an opening 60 therethrough which can likewise be axially aligned with the openings 42 of the raised support surfaces 40 to receive the retaining member 44 therethrough. The pivot adapter 58 has a neck 62 connected to the cross member 59 via a pin 63 (or other fastener e.g., screw). The neck 62 has a threaded opening 64 to receive a threaded end 66 of the pole handle 36. Other configurations are contemplated such as an end of the pole which can include an opening with a bearing surface to receive the retaining member 44 to provide a hinge mechanism and permit the pivoting of the handle 36. The universal joint allows the composite support structure 20 to be disposed in a plurality of angular positions with respect to the handle 36.

Figure 2:
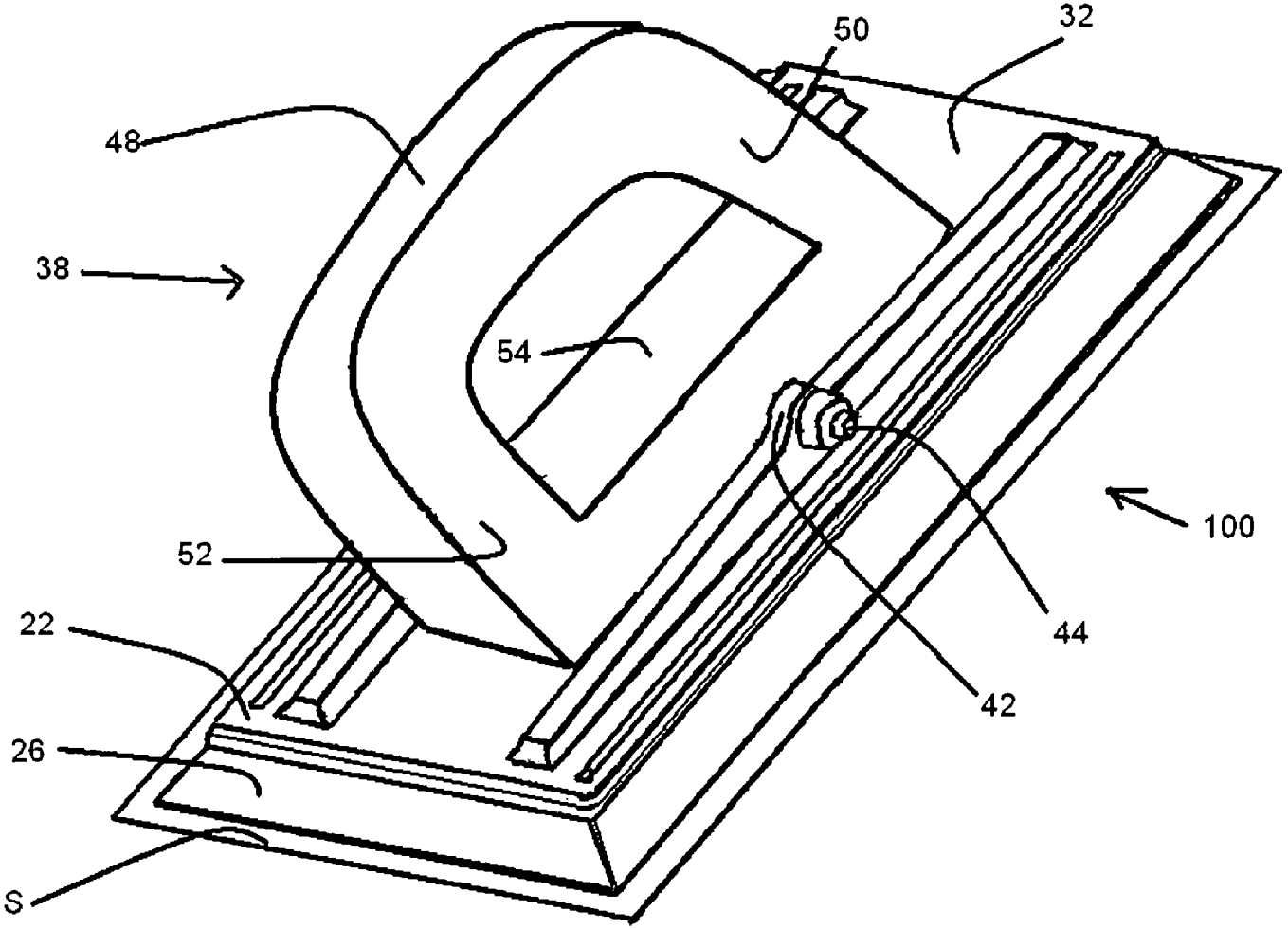
FIG. 2 is a view in perspective of an embodiment of a hand sander in accordance with the principles of the present invention.
Figure 3:
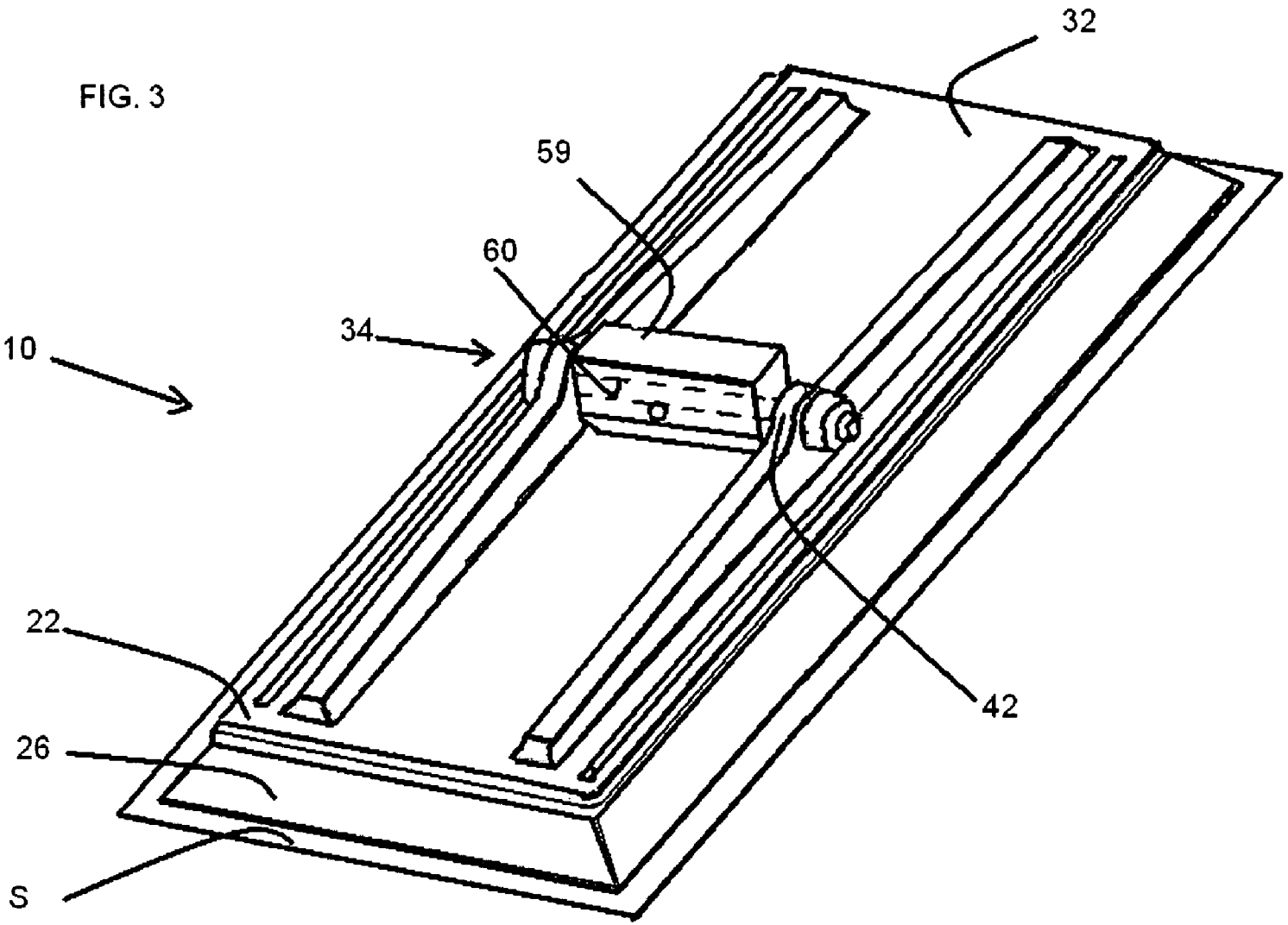
FIG. 3 is a view and perspective of part of the embodiment shown in FIG. 1.
Figure 4:
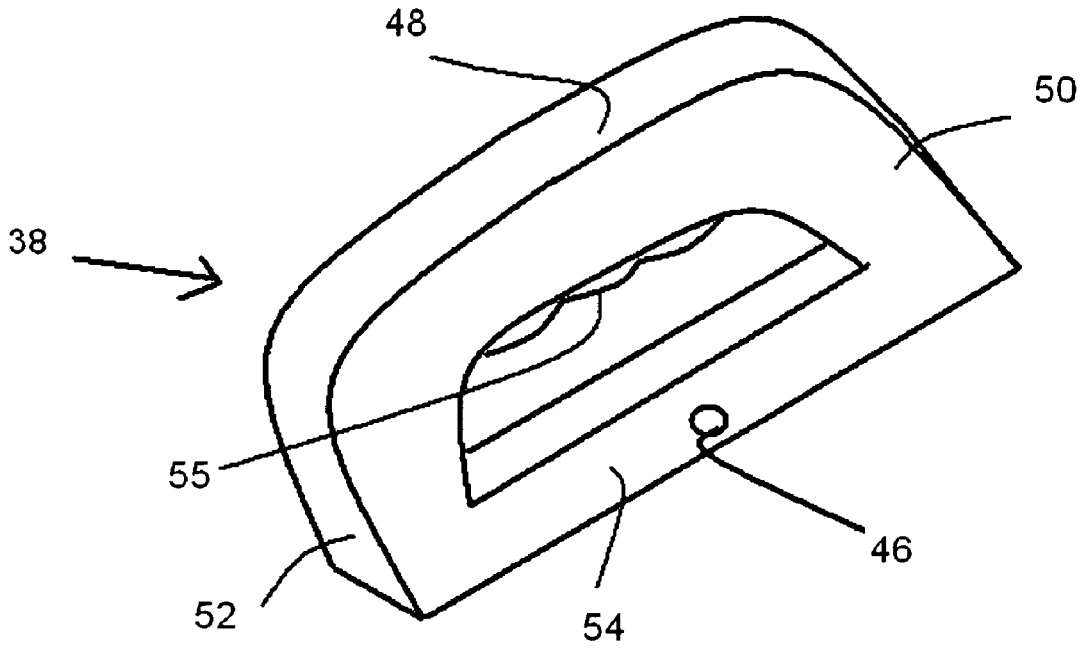
FIG. 4 is a view and perspective of part of the embodiment shown in FIG. 2.
Figure 5:
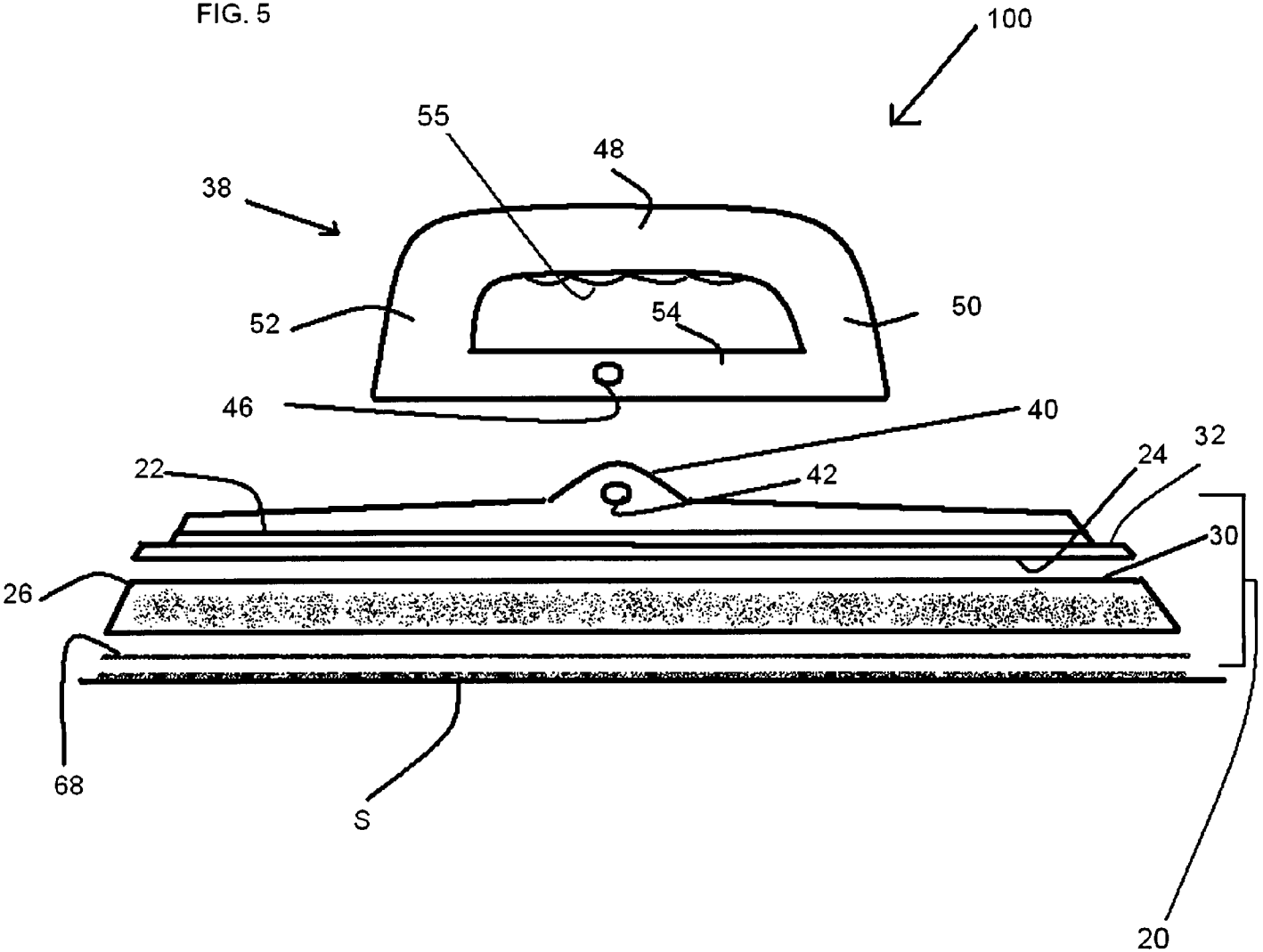
FIG. 5 is an exploded side view of an embodiment of the invention.
Figure 6:
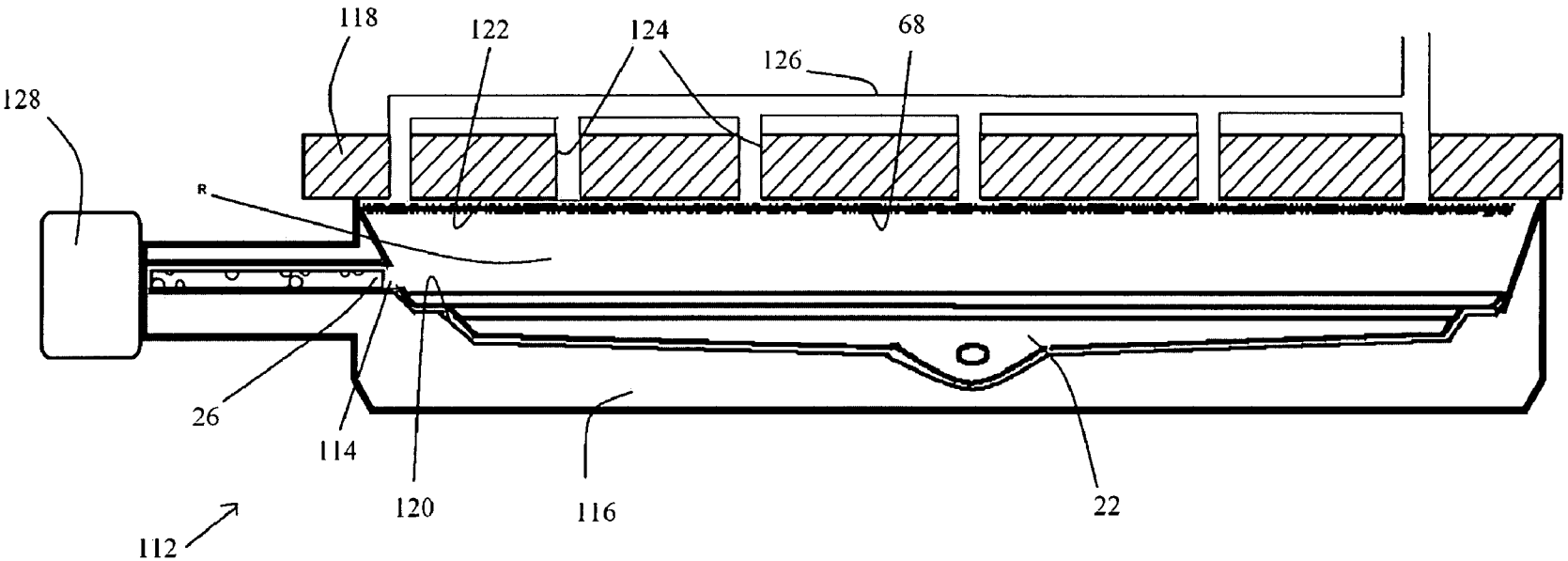
FIG. 6 depicts cross section of a mold illustrating a method of making the present invention.

Additionally, a hook and loop member 68 can be integrally formed into the front surface 8 of the polyfoam layer 26 as part of the composite support structure 20 thereby enabling a hook/loop sandpaper S to be attached thereto. The hook and loop member 68 can be made of a sheet member of a hook and loop Velcro material. An exploded view of this can be seen in FIG. 5. In the case of omitting the a hook and loop member 68, the composite 20 can be used with a stick back sandpaper as illustrated in FIGS. 1 and 2, for example. The present invention also provides for a kit assembly including the composite support structure 20 for use in sanding and interchangeable loop handle 38 and pole handle 36.

A method of forming the composite support structure 20 for use in sanding is provided. The method includes positionably disposing within an injection mold a rigid plate having a first surface and a second surface configured with means for connecting a handle such that the second surface is disposed on a first surface of the injection mold and injecting a polyfoam material around the first surface of the rigid plate in a manner such that a substantially uniform layer of the polyfoam is integrally connected thereto. The method further includes disposing a hook and loop member adjacent a second surface of the injection mold in a manner to maintain a gap between the hook and loop member 68 and the rigid plate 22. The step of injecting is further characterized to include injecting between the hook and loop member and the rigid plate the polyfoam.

More particularly, the composite support structure 20 is formed via a molding process, preferably using Reaction Injection Molding (or RIM). The process is one in which two reactive liquid components, a polyol and an isocyanate, for example are metered, blended together, and injected into a closed mold at low pressure.

Here, the present invention uses a mold 112 configured with a cavity 114 configured for forming the composite support structure 20. The mold 112 is operatively connected to a feed mechanism 128 including one liquid component, e.g., isocyanate, feed lines, a pump and return line and another liquid component, e.g., polyol, by another feed lines, pump, return line, exchanger and nucleator. The mold 112 includes a bottom 116 and a top 118 which include inner opposing surfaces 120 and 122, respectively, which collectively form the cavity 114. The surface 120 is configured to receive the back surface 32 of the rigid plate 22 (or 322) and surface 122 can include a flat surface, for example, to receive the hook and loop portion 68 thereagainst. To aid in holding the hook and loop portion 68 in place, a series of vacuum orifices 124 can be formed in the top 118 which connect to vacuum lines 126. The front surface 24 or 324 of the rigid plate 22 or 322, respectively, includes outer and inner walls which define a plurality of contained surfaces mechanically retaining the polyfoam layer 26 and to which the polyfoam layer 26 is mechanically bonded.

Once the composite support structure 20 and optionally the hook and loop portion 68 are in their respective positions, the mold 112 is supplied with the two reactive liquid components into the mold 112 in a manner in which the two materials enter a region R which forms the shape of the polyfoam layer 26. Upon a reaction between the components, the polyfoam layer 26 is formed which is bonded to the rigid plate 22 and hook and loop portion 68. The method of making the composite support structure 20 can include amounts of the two components forming the polyfoam layer 26 to aid in the control of a chemical reaction such that the components only permeate a portion of t hook and loop portion 68 through a surface facing the components as they react as well as sufficiently bond to the rigid plate 22. In a preferred embodiment, the liquids include a polyol and an isocyanate which can be metered, blended together, and injected into the mold 112 at low pressure to form the polyurethane structural foam. Typically, the foam part contacting the mold 112 results in an exposed outer dense durable skin and an inner unexposed less dense core. The percentage of materials determines the amount of rigidity to the polyfoam layer 26. Subsequent the reaction, composite support structure 20 is removed from the mold 112 and can be trimmed to provide a finished portion of the product.

After forming, an abrasive material, such as a sandpaper sheet S which can have of the hook and loop member 68 (Velcro) on a backing thereof or simply be a sticky back sandpaper, can be fastened to the loop member to provide the sanders 10 and 100 as seen in FIGS. 1 and 2. The sanders 10 and 100 shown are exemplary of that contemplated by the inventor and it is contemplated that there can be a design changes to facilitate a particular use of the implement, such changes in shape. By so providing, the instant invention enables the manufacture of improved sanders 10 and 100 which offer desirable qualities in ease of use and durability than previously available.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations. While the above described embodiments are set forth by way of example, they are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A method of making a composite support structure for a sander, which includes the steps of:

(a) providing a mold having a top part and a bottom part which when brought in operative position adjacent each other substantially define a composite support structure cavity and said top part is formed with a flat inner surface and is equipped to provide a vacuum across said flat inner surface;

(b) providing a rigid plate having a back surface and a front surface wherein said back surface is operatively disposed adjacent said bottom part of said mold such that a polyfoam layer can be formed to said front surface thereof, wherein said rigid plate front surface includes an inner wall defining a contained surface to aid in maintaining connection of said polyfoam thereto, and said rigid plate has a back surface configured for connection to a handle and said bottom part of said mold is configured to receive said back surface of said rigid plate;

(c) providing a flat sheet consisting of hook and loop members present entirely over said sheet, wherein said sheet is maintained flat by said vacuum while directly connected to said flat inner surface, said sheet of a size smaller than said cavity, said sheet having a front surface and a back surface, wherein said front surface is disposed and held by vacuum adjacent said flat inner surface of said top part of said mold; and (d) introducing into the mold fluid components which react to form a polyfoam which is reaction bonded to said front surface of said rigid plate such that a back surface of the polyfoam layer forms within said contained surface of said rigid plate and about said inner wall in a complementary manner thereto and a front surface of the polyfoam layer extends outward from said front surface of said rigid plate and when said top part is brought in contact with said bottom part said sheet does not extend outside said cavity and remains in spaced relation from said front surface of said rigid plate by vacuum such that said sheet is integrally formed into said front surface of said polyfoam as part of said composite support structure thereby enabling a hook/loop sandpaper to be attached thereto and said front surface of said sheet is formed to have a relatively planar surface maintained at a fixed space relation from said rigid plate thereby rendering said composite support structure for removably connecting sandpaper to said relatively planar configuration.

2. The method of making a composite support structure for a sander of claim 1, wherein said back surface of said rigid plate has means for connecting a handle.

3. The method of making the sander of claim 1, which further includes connecting a piece of sandpaper to said front surface of said sheet.

4. The method of making the sander of claim 1, which further includes connecting a piece of hook/loop sandpaper to said sheet.

5. The method of making the sander of claim 1, which further includes connecting a pole handle to said means for connecting said handle.

6. The method of making the sander of claim 1, which further includes connecting a loop handle to said means for connecting said handle, wherein said loop handle includes a first intermediate portion extending longitudinally along said back surface of said rigid plate in a laterally displaced manner therefrom and interconnects two downwardly extending ends which connect to a second intermediate portion which extends longitudinally adjacent said back surface and wherein said intermediate portions and said ends are spaced apart from one another to allow for placement of a user's hand about the first intermediate portion.

* * * * *